US008773222B2

(12) United States Patent
Myllyvainio et al.

(10) Patent No.: US 8,773,222 B2
(45) Date of Patent: Jul. 8, 2014

(54) FILTER ASSEMBLY

(75) Inventors: Esa Myllyvainio, Solna (SE); Benny Gustafson, Spanga (SE)

(73) Assignee: Telefonaktiebolaget L M Ericsson (publ), Stockholm (SE)

( * ) Notice: Subject to any disclaimer, the term of this patent is extended or adjusted under 35 U.S.C. 154(b) by 576 days.

(21) Appl. No.: 12/864,835

(22) PCT Filed: Mar. 31, 2008

(86) PCT No.: PCT/SE2008/050370

§ 371 (c)(1),
(2), (4) Date: Jul. 27, 2010

(87) PCT Pub. No.: WO2009/096836

PCT Pub. Date: Aug. 6, 2009

(65) Prior Publication Data

US 2010/0308937 A1 Dec. 9, 2010

(30) Foreign Application Priority Data

Jan. 31, 2008 (SE) ..... 0800239

(51) Int. Cl.
*H01P 1/20* (2006.01)
*H01P 7/10* (2006.01)
*H01P 1/208* (2006.01)

(52) U.S. Cl.
CPC ..... *H01P 1/2084* (2013.01); *H01P 7/10* (2013.01)
USPC ..... 333/202; 333/219.1

(58) Field of Classification Search
CPC ..... H01P 1/2084; H01P 7/10
USPC ..... 333/202, 203, 206, 207, 222–226
See application file for complete search history.

(56) References Cited

U.S. PATENT DOCUMENTS

| | | | | |
|---|---|---|---|---|
| 3,973,226 | A | 8/1976 | Affolter et al. | |
| 4,642,591 | A * | 2/1987 | Kobayashi | 333/227 |
| 5,680,080 | A | 10/1997 | Nishiyama et al. | |
| 5,783,979 | A * | 7/1998 | Andoh et al. | 333/202 |
| 6,304,157 | B1 * | 10/2001 | Wada et al. | 333/202 |
| 6,320,484 | B1 * | 11/2001 | Furuya et al. | 333/219.1 |
| 2005/0030131 | A1 * | 2/2005 | Yamakawa et al. | 333/202 |
| 2005/0219013 | A1 * | 10/2005 | Kumar et al. | 333/203 |
| 2005/0270120 | A1 | 12/2005 | Guo | |

FOREIGN PATENT DOCUMENTS

| | | | |
|---|---|---|---|
| JP | 1109802 | A | 4/1989 |
| JP | 2005223665 | A | 8/2005 |

* cited by examiner

*Primary Examiner* — Benny Lee
*Assistant Examiner* — Gerald Stevens
(74) *Attorney, Agent, or Firm* — Coats & Bennet, P.L.L.C.

(57) ABSTRACT

An object of the present invention is to provide an improved and simplified filter assembly. The object is achieved by a dielectric rod (120, 610, 620) for a filter chassis (110). The dielectric rod (120, 610, 620) extends between a first end (121) and a second end (122). The dielectric rod (120, 610, 620) comprises a conductive element (150) placed at the first (end 121). The conductive element (150) is adapted to be in conductive contact with a first contact means (141) of the filter chassis (110). The dielectric rod further comprises a second fastening element (160) placed at the second end (122). The second fastening element (160) is adapted to be attached and detached to a first fastening element (131) comprised in the filter chassis (110), such that the dielectric rod (120, 610, 620) is replaceable in the filter chassis (110).

18 Claims, 4 Drawing Sheets

FILTER ASSEMBLY

TECHNICAL FIELD

The present invention relates to the field of filters. More particularly the present invention relates to a dielectric rod, a filter chassis, a filter assembly as well as a radio transmission device comprising such a filter assembly.

BACKGROUND

Filters are circuits which may be used in communication systems to compensate for disturbances such as e.g. interference, etc. caused by the nature of the transmission media between sender and receiver. Filters remove the unwanted communication signal components and/or enhance the wanted communication signal components.

Radio Frequency (RF) filters and Microwave filters represent a class of filters, designed to operate on signals in the Megahertz to Gigahertz frequency ranges. This frequency range is the range used by most broadcast radio, television and wireless communication systems such as e.g. cellular communication systems, Wi-Fi, WiMax, LTE, etc. Thus most wireless communication devices will include some kind of filtering device performing filtering on the signals transmitted and/or received. Further are filters located in the radio interface communication nodes such as e.g. the radio antenna of the broadcast radio system, the TV broadcasting antenna of the television system and the radio base station of the cellular telephone system. Such filters are commonly used as building blocks for duplexers and diplexers to combine or separate multiple frequency bands.

Today two technologies predominates the radio base station front end filters. These filters, coaxial filters and ceramic filters each consists of a number of resonators, coupled together providing a proper transfer of wanted signals and rejection of unwanted signals.

A driving force within the development of filters today is the issue of size. The smaller the filters are, the smaller may the electronic devices, the filters are installed in, be made. This reduces the required space of the equipment for storage, shipment and installation at the customer's site. Thus it is desirable to be able to produce as small filters as possible with sufficient performance.

The performance of filters may be measured by their Quality or Q factor. A filter is said to have a high Q factor if the filter is capable of selecting or rejecting a range of frequencies that is narrow in comparison to the centre frequency. The Q factor represents a relationship between a stored and dissipated energy in a resonant circuit. The Q factor may be defined as the ratio of centre frequency divided by 3 dB bandwidth. The pass band loss of a filter is inversely proportional to unloaded Q.

The classical coaxial resonators with metal center conductor provide normal performance, such as e.g. a Q factor of 2500 with the cavity volume of 22*22*22 $mm^3$ or a Q factor of 4300 with the cavity volume of 37*37*37 $mm^3$ at 2 GHz frequency, and low manufacturing cost. These classical coaxial resonators are fairly scale able in size, such as e.g. coaxial resonator lengths from 15 mm to 100 mm depending on the frequency used. The coaxial resonators may make use of high-dielectric constant materials to reduce their overall size and thus enable the scalability. One disadvantage with ordinary coaxial resonators may be the limited power handling capability, which is caused by the small gap between the resonator and the tuning element.

The ceramic resonators, such as e.g. ceramic Transverse Electric (TE) TE01d single mode resonators, are used for high performance, such as e.g. a Q factor of 10000 and above. Ceramic resonators provide higher performance compared to classical coaxial resonators or waveguides with a maximum Q factor being less than 10000 at 2 GHz frequency.

Ceramic resonators are made of high-stability piezoelectric ceramics, generally lead zirconium titanate (PZT) which functions as a mechanical resonator. Ceramic resonators for TE and TM mode are made of a material compound of e.g. oxygen (O), barium (Ba), titanium (Ti), zinc (Zn), neodymium (Nd), and lanthanum (La). The TE01d single mode ceramic resonators require rather large cavities. At 1.9 GHz frequency the Q factor is about 3200 for a coaxial resonator when cavity is about 30*30 mm (height*diameter). The size of the TE01d single mode ceramic puck resonator is about 27.5*10 mm (height*diameter) in the same cavity as above. Smaller cavity size with TE01d mode at 1.9 GHz frequency is not possible, because it is then necessary to increase the puck diameter.

Furthermore a few manufacturers have used dielectric resonators such as e.g. Transverse Magnetic (TM) single mode resonators, as radio base station front end filters. TM resonators enable considerable size reduction compared to metal resonators. The Japanese patent application JP0310802 A, published May, 9, 1991, presents such a TM single mode resonator which facilitating size reduction without loss of performance relative to a metal coaxial resonator, the metal coaxial resonator having a coaxial metal rod which has the same resonant frequency as the ceramic TM single mode resonator. A typical TM single mode resonator saves 20-50% volume, depending on the resonant frequency and dielectric constant of the ceramic, compared to a coaxial metal resonator of the same unloaded Quality factor.

Other technologies which also have been used for radio base station front end filters are very complex shaped TM dual mode resonators and TM triple mode resonators. The Japanese patent application JP05048305 published Feb. 26, 1993, introduces such a small sized, light weight and inexpensive band rejection filter using a TM dual mode dielectric resonator. The size reduction with this technology is about 30-80% compared to a coaxial metal resonator of the same unloaded Quality factor and of the same resonant frequency.

The application of TM mode is when both resonator ends are grounded. A commonly used method for grounding both resonator ends is e.g. soldering the dielectric rods directly to the filter housing and filter lid. A problem with the existing solution, using soldering to attach the TM mode dielectric rods to the filter housing and/or the lid, is that once the dielectric rod have been assembled and soldered, the dielectric rod cannot be replaced. To replace one single dielectric rod in a filter, at least one end of all the other soldered dielectric rods in the filter must be de-soldered, such as e.g. de-soldered from the lid side. In practice, this is however not possible, due to the fact that the conductive plating material, such as e.g. the silver plating, at the dielectric rod ends will only be good for one soldering operation, thus the dielectric rod is not replaceable.

After the filter has been assembled by grounding the dielectric rods, the filter is frequency tuned. The filter may be frequency tuned by removing material from the dielectric rods. However, frequency tuning performed by removing material is irreversible, i.e. the frequency tuning can only be performed in one way. This involves a considerable risk that too much material is removed which makes the dielectric rods and the whole ceramic filter accordingly of less use and most probably even useless. Secondly there is a considerable risk that the dielectric rods are damaged. Today it is not possible to add material that has been removed, or repair a dielectric rod that has been damaged. The result of this is a potentially very high scrap cost since the whole filter has to be scrapped if one single frequency tuning operation fails.

Another way of frequency tuning the filter is by inserting a tuning screw into a hollow in the dielectric rod as presented by the U.S. Pat. No. 6,535,086 B1, issued Mar. 18, 2003. This method is reversible since the tuning screw easily may be screwed in and unscrewed. However a disadvantage of this method is that the hollow and the tuning screw will decrease the filter performance, i.e. lower the Q factor, and also reduce the power handling capability. This results in that the size reduction is smaller using this method of frequency tuning than with the method of removing material from the dielectric rod to tune the frequency.

A further disadvantage of the existing solutions of grounding the dielectric rod ends by soldering is that it is difficult to get a repeatable soldering process for a complete filter consisting of several dielectric rods when soldering directly to the filter housing and the filter lid. This is because of the product mass of the filter housing and filter cover being high which causes the filter housing, filter cover and ceramics to heat up slowly which delays the soldering considerably. This may further have a negative effect on the long term solder joint reliability. When the whole filter assembly is heated, it is also required that all components inside the product can withstand the soldering temperature; this will limit the choice of material, such as e.g. plastics, and possibly also increase the material cost. A high mass product is also difficult to handle after the soldering operation because of the latent heat in the filter housing, lid and ceramics, thus the cool down process has to be long, which increases the manufacturing lead time and cost. Further the multiple solder joint orientations, such as e.g. two directions in the case of a TM single mode filter or four in the case of a TM dual mode filter, complicates the soldering process. Moreover, when soldering directly to the filter housing and lid it is necessary to have tight mechanical tolerances, and that is also cost driving.

SUMMARY

It is therefore an object of the present invention to provide a scalable filter assembly with high performance.

According to a first aspect of the present invention, a dielectric rod for a filter chassis is provided. The dielectric rod extends between a first end and a second end. The dielectric rod comprises a conductive element placed at the first rod end. The conductive element is adapted to be in conductive contact with a first contact means of the filter chassis. The dielectric rod further comprises a second fastening element placed at the second rod end. The second fastening element is adapted to be attached and detached to a first fastening element comprised in the filter chassis, such that the dielectric rod is replaceable in the filter chassis.

According to a second aspect of the present invention, a filter chassis for a dielectric rod is provided. The filter chassis comprises a first contact means adapted to be in conductive contact with a conductive element of the dielectric rod. The filter chassis further comprises a first fastening element adapted to attach and detach to a second fastening element at the dielectric rod, such that the dielectric rod is replaceable in the filter chassis.

According to a third aspect of the present invention, a filter assembly is provided. The filter assembly comprises a dielectric rod and a filter chassis.

According to a fourth aspect of the present invention, a radio transmission device is provided. The radio transmission device comprises at least one filter assembly.

Since the dielectric rods of the filter assembly are individually replaceable a scalable filter assembly with high performance is provided.

An advantage of the present invention is a potential drastic reduction in scrap cost since the dielectric rods can be replaced individually since the dielectric rods are attached using fastening elements and not soldering.

A further advantage of the present invention is that the filter assembly design is less tolerance sensitive due to the conductive element of the dielectric rod.

Another advantage of the present invention is the scalability enabling significantly smaller filter assemblies compared to prior art. This is due to the replaceable dielectric rod.

A further advantage of the present invention is a more repeatable soldering of the dielectric rod is possible due to the fact that each dielectric rod may be soldered separately/individually.

DETAILED DESCRIPTION

The invention is defined as a filter assembly which may be put into practice in the embodiments further described below.

Figure 1:
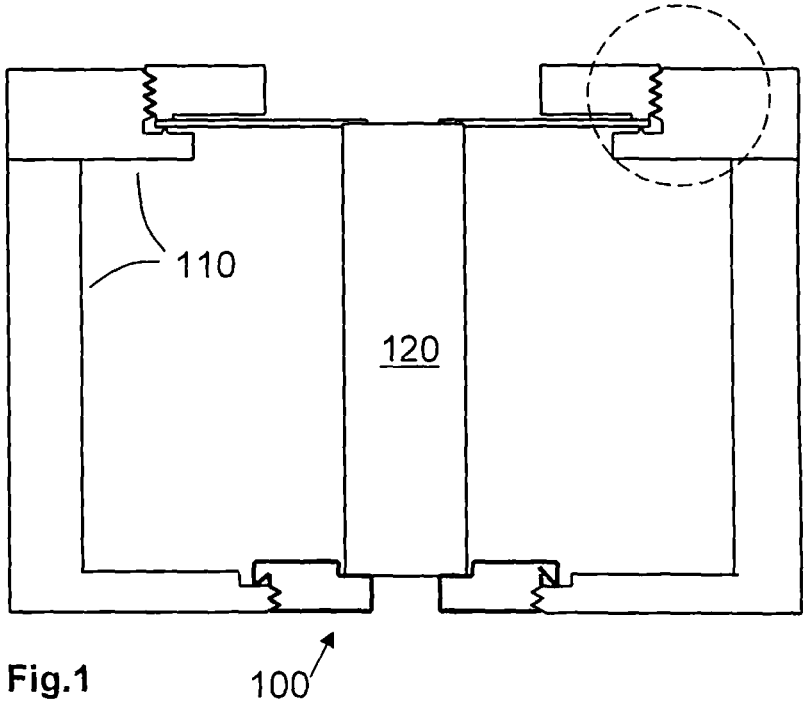
FIG. 1 is a cross-section view of a filter assembly according to some embodiments.

FIG. 1 presents a cross section of a filter assembly 100 according to some embodiments of the invention. The filter assembly 100 comprises a filter chassis 110 and at least one dielectric rod 120. The filter assembly 100 according to the present solution may comprise a plural of dielectric rods 120, such as e.g. as many as 30. However, only one dielectric rod 120 is depicted in FIG. 1. The filter assembly 100 may be a TM single mode resonator.

Figure 2:
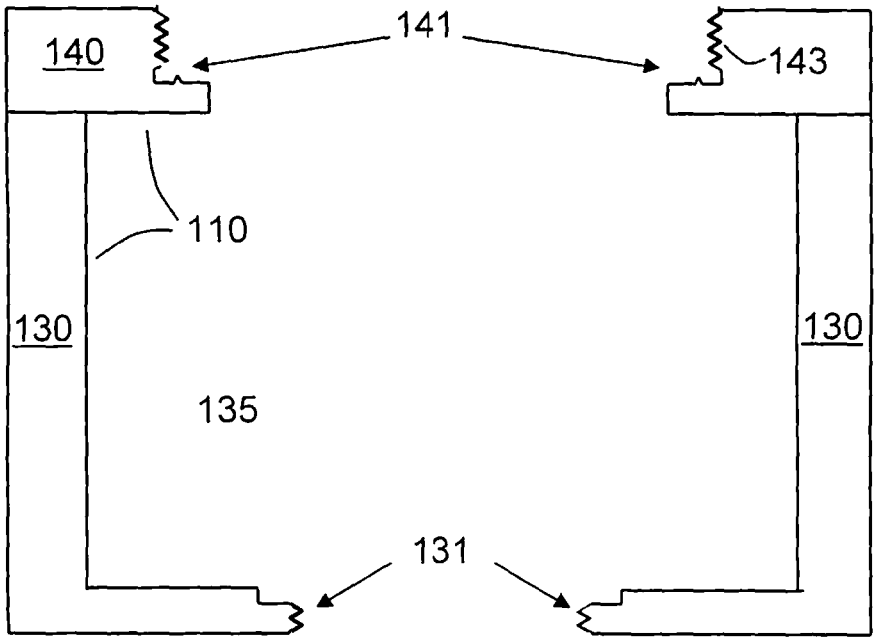
FIG. 2 is a cross-section view of a filter chassis according to some embodiments.

FIG. 2 depicts a cross section of the filter chassis 110. The filter chassis 110 may comprise a filter housing 130, a filter cavity 135 and a filter cover 140. Examples of filter covers 140 are e.g. a lid, cap, cover. The filter housing 130 may be adapted to be arranged together with the filter cover 140. The filter housing 130 and filter cover 140 may be made of e.g. silver plated copper on aluminum. The filter chassis 110 comprises a first contact means 141. The first contact means 141 may be located on the filter cover 140. The first contact means 141 may be represented by e.g. a bevel cutting with a hole, a chamfering with a hole, a plateau with a hole in the filter cover 140. The first contact means 141 of the filter chassis 110 is adapted to be in conductive contact with a conductive element 150 of the dielectric rod 120. Further the filter chassis 110 comprises a first fastening element 131. The first fastening element 131 may be located on the filter housing 130. The first fastening element 131 may be represented by a threaded hole, a spiral hole, a tapped hole and/or a screw hole. The first fastening element 131 is adapted to be attached and detached to a second fastening element 160 of the dielectric rod 120 making the dielectric rod 120 replaceable.

Figure 3:
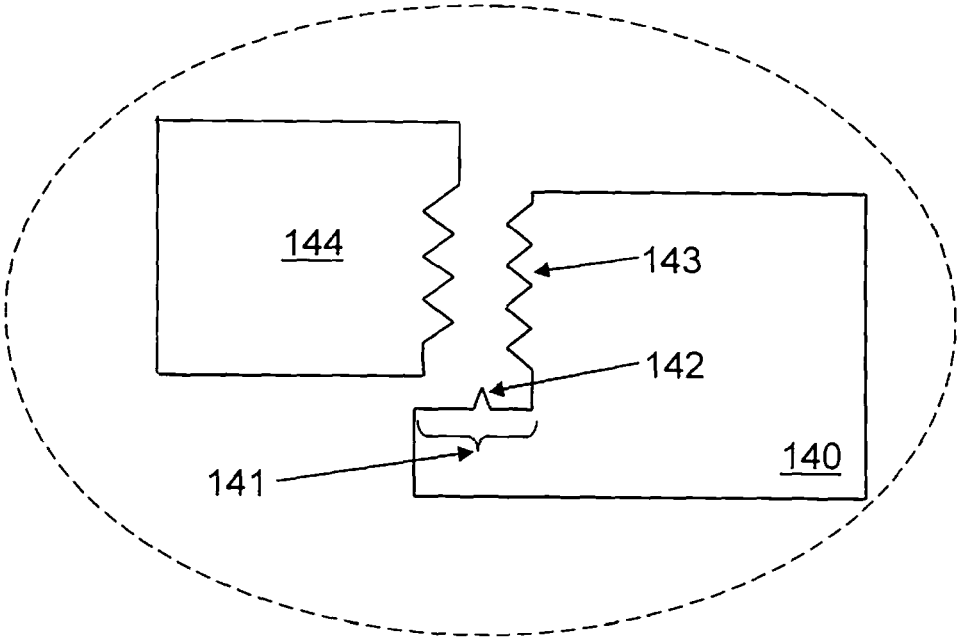
FIG. 3 is a close-up view of a filter cover according to some embodiments.

FIG. 3 depicts a close-up view of the filter cover 140. The filter cover 140 comprises the first contact means 141. According to some embodiments the first contact means 141 may comprise a first projecting element 142, such as a sharp edge, or a small contact area, adapted to enhance the conductive contact between the filter chassis 110 and the conductive element 150 of the dielectric rod 120. Further the filter chassis 110 may comprise a third fastening element 143 and a fourth fastening element 144. According to some embodiments the filter cover 140 may comprise the third fastening element 143 and the fourth fastening element 144. Examples of the third fastening element 143 are e.g. a threaded hole, a spiral hole, a tapped hole and/or a screw hole. Examples of the fourth fastening element 144 are e.g. a screw, a coil, a bolt and/or a rivet. The third fastening element 143 is adapted to attach and detach the fourth fastening element 144. The fourth fastening element 144 is adapted to be attached and detached to the third fastening element 143.

Figure 4:
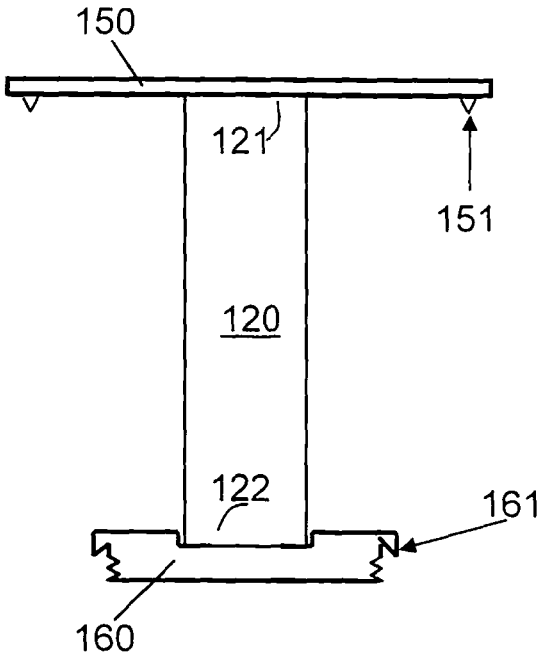
FIG. 4 a cross section view of a detail of a filter assembly according to some embodiments.

FIG. 4 depicts a cross section of the dielectric rod 120 according to some embodiments. The shape of the dielectric rod 120 may be e.g. cylindrical, circumferential, cornered or edged such as e.g. having a quadrangular, hexagonal or octagonal cross section. The dielectric rod 120 may be made of a dielectric material such as ceramic. The ceramic may be a material compound of e.g. oxygen (O), barium (Ba), titanium (Ti), zinc (Zn), neodymium (Nd), lanthanum (La), etc. The dielectric rod 120 extends between a first end 121 and a second end 122. The first end 121 and the second end 122 may be coated with a conductive material intended to enhance the conducting qualities, such as e.g. a stable resonant frequency and a high Q factor, between the dielectric rod 120 and the filter chassis 110 when the filter assembly 100 is mounted/assembled. Examples of such conductive materials are e.g. silver, a palladium silver compound, layers of silver, nickel and gold or layers of silver, nickel and tin.

To make the dielectric rod 120 replaceable and thus reducing the scrap cost of the filter assembly 100 the dielectric rod 120 further comprises the conductive element 150 and the second fastening element 160.

The conductive element 150 is arranged to the first end 121 of the dielectric rod 120. The conductive element 150 is arranged to the first end 121 e.g. by soldering or attached by conductive glue. Examples of a conductive element 150 may be e.g. a washer, a plate, a tray, a chip, a ferrule. The conductive element 150 is adapted to represent a conductor between the dielectric rod 120 and filter cover 140 of the filter chassis 110. According to some embodiments the conductive element 150 may be adapted to be in conductive contact with the first contact means 141 of the filter chassis 110. The conductive element 150 is placed at the first end 121 of the dielectric rod 120. The conductive element 150 may be flexible to further enhance the conducting qualities between the dielectric rod 120 and the filter chassis 110 when the filter assembly 100 is mounted and/or assembled. The conductive element 150 may comprise a second projecting element 151, such as e.g. a sharp edge which enables the requested small contact area between the conductive element 150 and the filter chassis 110. The conductive element 150 may further be slightly elastic to be adapted to compensate for mechanical tolerances in the filter chassis 110, such as in the filter housing 110 and in the filter cover 140, as well as to compensate for the mechanical tolerances in the dielectric rod. This is highly advantageously since the elastic conductive element 150 makes the filter assembly 100 less tolerance sensitive than the previously known filter solutions.

The second fastening element 160 is placed at the second end 122 of the dielectric rod 120. Examples of second fastening elements 160 are e.g. a screw, a coil, a bolt and/or a rivet. The second fastening element 160 may be arranged to the second end 122 of the dielectric rod 120 e.g. by soldering or attached by conductive glue. The second fastening element 160 is adapted to be attached and detached to the first fastening element 131 comprised in the filter chassis 110 which allows for the dielectric rod to be replaceable in the filter assembly 100. It is desirable that the contact area between the second fastening element 160 and the first fastening element 131 is small and the contact performed with enough torque to ensure high contact between second fastening element 160 and the first fastening element 131. According to some embodiments the second fastening element 160 comprises a third projecting element 161, such as e.g. a sharp edge, which enables the requested small contact area between the first fastening element 131 and the second fastening element 160. This is highly advantageous since this condition achieves high filter performance such as e.g. a high Q-value and low Inter Modulation Distortion (IMD). IMD is an unwanted signal caused by non-linearity in material, junctions etc and two or more high power signals.

Soldering is used according to some embodiments of the present solution. The soldering process is highly improved compared to the prior art solutions since the soldering according to the present solution is performed much faster and much more repeatable since the soldering is performed prior to placing the dielectric rod inside the filter cavity. This is due to the fact that the mass of the filter chassis 110 is eliminated as a factor to consider for soldering. Thus less weight to warm up reduces the soldering time considerably. Further it is much easier to perform the soldering outside of the filter chassis 110 than inside as performed according to the prior art solutions. Yet further according to some embodiments the soldering may be a repeatable operation due to the silver plating of the dielectric rod 120. This is because the fixture may be used when soldering the conductive element 150 and the second fastening element 160 to the dielectric rod 120. This makes the soldering process less complex compared to the prior art case of simultaneously soldering a plural, such as e.g. 25, dielectric rods 120 to a filter chassis 110. The soldering method of the present solution involves a much smaller risk of a high temperature increase difference, and a much smaller time difference above the solder alloys liquidus (or melting) temperature, between the two soldering ends 121 and 122 of the dielectric rod 120 compared to the prior art.

The critical parameters to control to achieve a reliable solder joint, such as e.g. the temperature increase differences, the temperature decrease differences, the time spent above liquidus and the peak soldering temperatures may all be easily controlled using the soldering method according to the present solution.

Thus the soldering according to the present solution gives high quality soldering joints which is very advantageous.

The filter assembly 100 is assembled by inserting the dielectric rod 120 into the filter cavity 135. Further the dielectric rod 120 is attached to the filter chassis 110 in such a way that the dielectric rod 120 may be detached without damaging the dielectric rod 120 or the filter chassis 110. Thus the dielectric rod 120 is replaceable!

According to some embodiments the dielectric rod 120 is firstly attached inside the filter chassis 110 by fastening, such as e.g. screwing, the second fastening element 160, such as e.g. the screw, of the dielectric rod 120, to the first fastening element 131, such as the screw hole, of the filter chassis 110 thus enabling mechanically fixing of the dielectric rod 120 to the filter chassis 110. The third fastening element 143 and the fourth fastening element 144 may be arranged to attach and detach the conductive element 150 of the dielectric rod 120 to the filter cover 140 of the filter chassis 110, thus enabling the dielectric rod 120 to be attachable and detachable to the filter chassis 110. The fourth fastening element 144 may be adapted to push the conductive element 150 in contact with the first contact means 141 when being fastened to the third fastening element 143, thus ensuring high connectivity between the filter chassis 110 and the dielectric rod 120. According to some embodiments the fourth fastening element 144 may be a screw with anti rotation function adapted to prevent the conductive element 150 from rotating. According to some embodiments the conductive element 150 and/or the fourth fastening element 144 may be lubricated to prevent the conductive element 150 from rotating.

Figure 5:
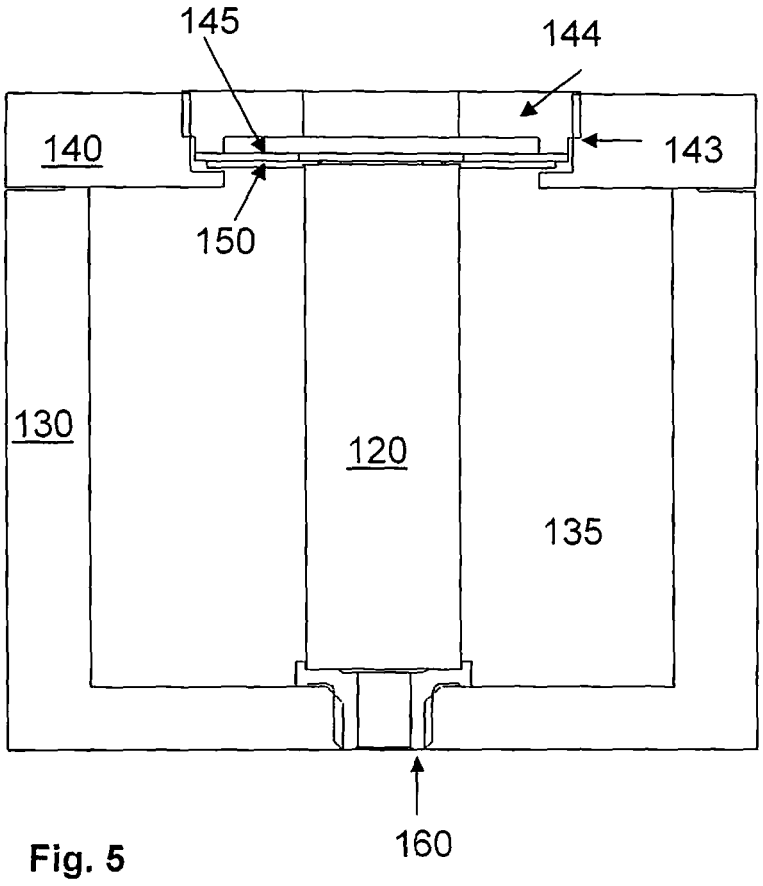
FIG. 5 is a cross section view of a filter assembly according to some embodiments.

Further according to some embodiments the filter chassis 110 may comprise a fifth fastening element 145. Examples of a fifth fastening element 145 may be e.g. an anti rotation element or an anti rotation washer. FIG. 5 depicts the fifth fastening element according to some embodiments. The fifth fastening element 145 may be adapted to be used together with the fourth fastening element 144. The fifth fastening element 145 may be arranged above the conductive element 150. The fifth fastening element 145 may be adapted to reduce the risk of shear stress between the conductive element 150 and the dielectric rod 120. The fifth fastening element 145 may further be adapted to prevent the conductive element 150 from rotating.

According to some embodiments the conductive element 150 of the second end 122 of the dielectric rod 120 may be placed in contact with the first contact means 141 of the filter chassis 110. The fourth fastening element 144 is attached to the third fastening element 143 thus attaching the dielectric rod 120 to the filter chassis 110 by mechanically fixing, such as e.g. squeezing, the conductive element 150 of the dielectric rod 120 between the first contact means 141 of the filter cover 140 and the fourth fastening element 144 from the outside. To ensure good contact between the conductive element 150 and the filter cover 140 of the filter chassis 110, the connection must be good. This is achieved by high pressure between the filter cover 140, the conductive element 150 and the fourth fastening element 144. This is a condition to achieve high filter performance such as a high Q-value.

According to some embodiments the conductive element 150 of the second end 122 of the dielectric rod 120 may be placed in non-contact with the first contact means 141. Instead and the fourth fastening element 144 may be used to attach to the conductive element 150 to the filter cover 140 using high pressure. This may result in that the conductive element 150 is bent towards the filter cover 140.

Since the dielectric rod 120 is attached inside the filter cavity 135 to the filter chassis 110 by mechanically fixing, the dielectric rod 120 is detachable which makes it replaceable. According to some embodiments the filter assembly 100 comprises a plural of the dielectric rods 120. It is highly advantageous to use replaceable dielectric rods 120 in a filter assembly 100 because this enables significantly reduced scrap costs in production and considerable prolonged lifetime for the filter assembly 100. This is due to the fact that the filter assembly 100 may be repaired by replacing damaged and/or malfunctioning dielectric rods 120 instead of the filter being scraped. Thus the present solution offers a potential drastic reduction in scrap cost due to the fact that the dielectric rods 120 can be replaced individually.

Further the dielectric rods 120 according to the present solution may be used to form Transverse Electric filters and/or Transverse Magnetic single mode filters. According to some embodiments a plural of dielectric rods 120 may be arranged consecutive in parallel into one filter chassis 110 to form Transverse Electric filter and/or a Transverse Magnetic single mode filter.

Figure 6:
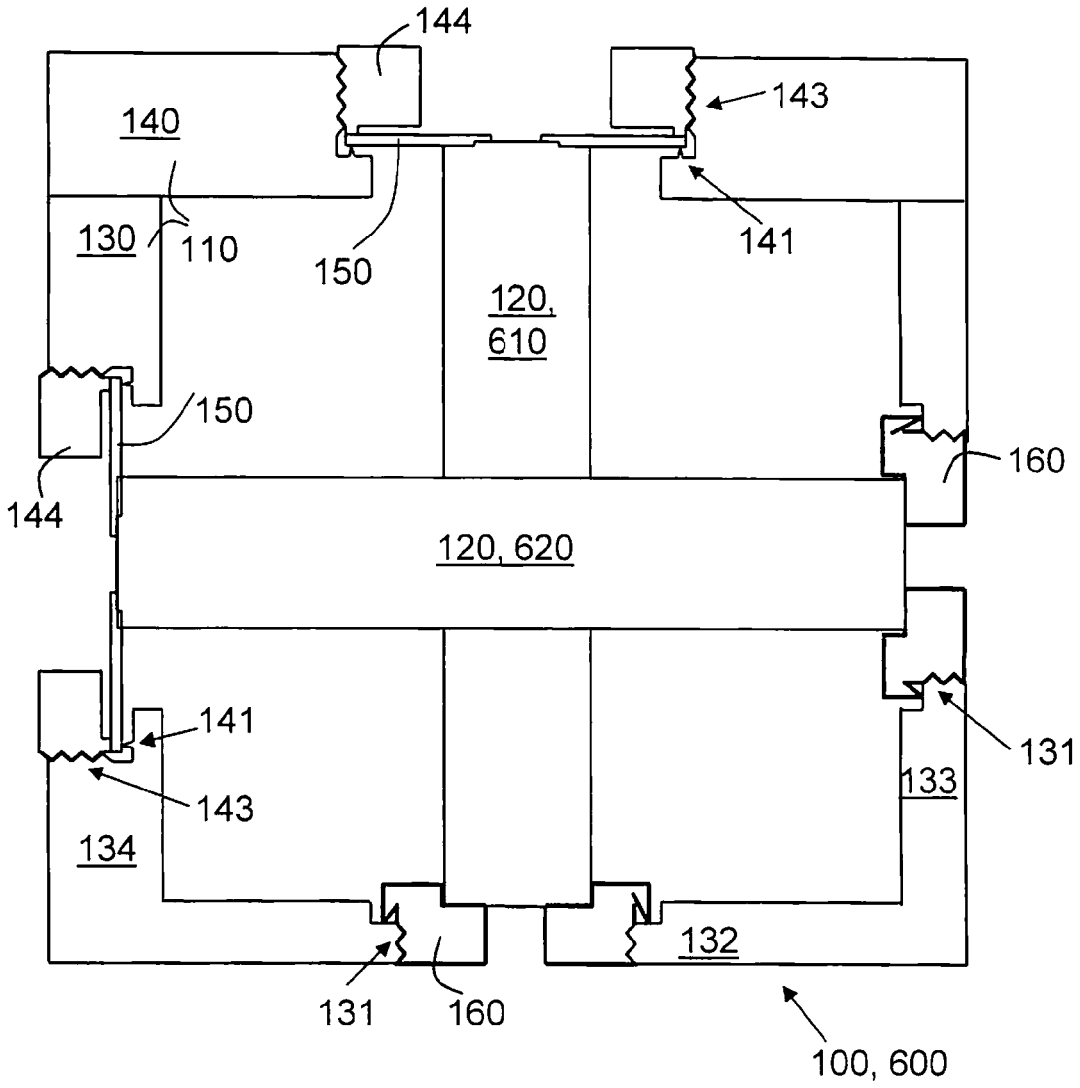
FIG. 6 is a cross section view of a filter assembly according to some embodiments.

According to some embodiments a plural of dielectric rods 120 may be arranged consecutive to form a Transverse Magnetic dual mode filter. These embodiments comprises a plural of dielectric rods 120 that may be arranged consecutive such that at least two of the plural of dielectric rods 120 are perpendicular and/or orthogonal to each other into one filter chassis 110. FIG. 6 depicts an exemplary scenario of a dual mode filter assembly 600, such as e.g. a Transverse Magnetic filter assembly, comprising two dielectric rods 120.

According to the example depicted in FIG. 6 a first dielectric rod 610 may be arranged into the chassis 110 by attaching the second fastening element 160 of the first dielectric rod 610 to a first of a plural of first fastening element 131 of the filter chassis 110 as described in detail above. The first of the plural of first fastening elements 131 may be arranged on a first part 132 of the filter housing 130, such as e.g. the base. The first part 132 may be the part opposite the filter cover 140. Further a first of a plural of third fastening elements 143 and a first of a plural of fourth fastening elements 144 may be arranged to attach the conductive element 150 of the first dielectric rod 610 to the filter chassis 110. The first of a plural of third fastening elements 143 and the first of a plural of fourth fastening elements 144 may be arranged on the filter cover 140 of the filter chassis 110.

Thus according to this exemplary scenario depicted in FIG. 6 the first dielectric rod 610 may be vertically arranged into the filter chassis 110.

Further according to the example of FIG. 6 a second dielectric rod 620 may be arranged into the filter chassis 110 by attaching the second fastening element 160 of the second dielectric rod 620 to a second of a plural of first fastening element 131 of the filter chassis 110 as described in detail above. The second of the plural of first fastening elements 131 may be arranged on a second part 133 of the filter housing 130, such as e.g. a first side part, which is perpendicular and/or orthogonal to the filter cover 140. Further a second of a plural of third fastening elements 143 and a second of a plural of fourth fastening elements 144 may be arranged to attach the conductive element 150 of the second dielectric rod 620 to the filter chassis 110. The second of a plural of third fastening elements 143 and a second of a plural of fourth fastening elements 144 may be arranged on a third part 134 of the filter housing 130, such as e.g. a second side part, which may be perpendicular and/or orthogonal to the filter cover 140. Further the second part 133 of the filter housing 130 may be opposite to the third part 132 of the filter housing 130.

The second dielectric rod 620 may thus be arranged perpendicular and/or orthogonally to the first dielectric rod 610. According to the exemplary scenario of FIG. 6, the second dielectric rod 620 may be arranged horizontal into the filter chassis 110.

Figure 7:
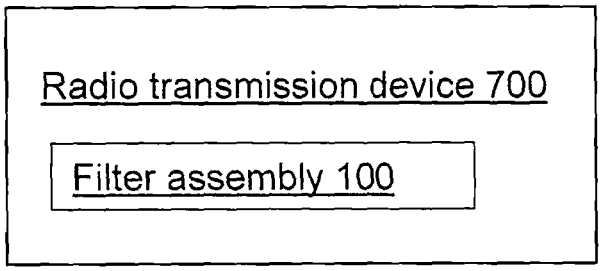
FIG. 7 is a block diagram of a filter assembly according to some embodiments.

The filter assembly 100, the filter chassis 110 and the dielectric rod 120 described by this document, may be of use in many different devices. Examples of such devices are communication transmitting devices such as wireless transmission devices such as a radio base station, a Tower Mounted Amplifier (TMA) and a Radio Remote Unit (RRU). FIG. 7 depicts a radio transmission device 700 according to some embodiments.

The present solution introduces a dielectric rod 120, 610, 620 for a filter chassis 110. The dielectric rod 120, 610, 620 extends between a first end 121 and a second end 122.

The dielectric rod 120, 610, 620 comprises a conductive element 150 placed at the first end 121. The conductive element 150 is adapted to be in conductive contact with a first contact means 141 of the filter chassis 110. According to some embodiments the conductive element 150 may be flexible and/or elastic. Further the conductive element 150 may comprise a second projecting element 151. The conductive element 150 may be placed at the second end 122 using solder and/or conductive glue.

The dielectric rod 120, 610, 620 further comprises a second fastening element 160 placed at the second end 122. The second fastening element 160 is adapted to be attached and detached to a first fastening element 131 comprised in the filter chassis 110, such that the dielectric rod 120, 610, 620 is replaceable in the filter chassis 110. According to some embodiments the second fastening element 160 may be placed at the first end 121 using solder and/or conductive glue. The second fastening element 160 may be represented by a screw, a coil, a bolt and/or a rivet. The second fastening element 160 may comprise a third projecting element 161.

The present solution further introduces a filter chassis 110 for a dielectric rod 120, 610, 620.

The filter chassis 110 comprises a first contact means 141 adapted to be in conductive contact with a conductive element 150 of the dielectric rod 120, 610, 620. According to some embodiments the filter chassis 110 may comprise a plural of first contact means 141. At least two of the plural of first contact means 141 may be orthogonally arranged. The first contact means 141 may comprise a first projecting element 142.

The filter chassis 110 further comprises a first fastening element 131 adapted to attach and detach to a second fastening element 160 at the dielectric rod 120, 610, 620, such that the dielectric rod 120, 610, 620 is replaceable in the filter chassis 110. According to some embodiments the filter chassis 110 may comprise a plural of first fastening elements 131. At least two of the plural of fastening elements 131 may be orthogonally arranged. The first fastening element 131 may be represented by a threaded hole, a spiral hole, a tapped hole and/or a screw hole.

According to some embodiments the filter chassis 110 may further comprise a third fastening element 143 being adapted to attach and detach a fourth fastening element 144. The filter chassis 110 may comprise a plural of third fastening elements 143. At least two of the plural of third fastening elements 143 may be orthogonally arranged. The third fastening element 143 may be represented by a threaded hole, a spiral hole, a tapped hole and/or a screw hole.

According to some embodiments the filter chassis 110 may further comprise a fourth fastening element 144 being adapted to be attached and detached to the third fastening element 143. The filter chassis 110 may comprise a plural of fourth fastening elements 144. At least two of the plural of fourth fastening elements 144 may be orthogonally arranged. The fourth fastening element 144 may be represented by a screw, a coil, a bolt and/or a rivet.

According to some embodiments the filter chassis 110 may comprise a fifth fastening element 145 being adapted to be used together with the fourth fastening element 144.

The present solution further introduces a filter assembly 100.

The filter assembly 100 comprises a dielectric rod 120, 610, 620 according to above. According to some embodiments the filter assembly 100 may comprise a plural of the dielectric rods 120, 610, 620. The dielectric rods 120, 610, 620 may be arranged in parallel to form a Transverse Electric filter. The dielectric rods 120, 610, 620 may be orthogonally arranged to form a Transverse Magnetic filter.

The filter assembly 100 comprises a filter chassis 110 according to above.

The present solution further introduces a radio transmission device 700 comprising at least one filter assembly 100 according to above. According to some embodiments the radio transmission device 700 may be represented by a radio base station, a Tower Mounted Amplifier (TMA) and or a Radio Remote Unit (RRU).

Compared to classical coaxial resonators, such as e.g. metal center conductors, the present solution with TM single mode offers significantly smaller filters, i.e. 20-50% space saving. Further compared to classical coaxial resonators, such as e.g. metal center conductors, the present solution with TM dual mode offers significantly smaller filters, i.e. 30-80% space saving.

Further the present solution enables filters with higher power handling capability because smaller coaxial metal rod filters reduce the power handling. Further the electrical breakdown is higher for dielectric material such as e.g. ceramics, than for air.

Compared with the prior art solution of a TM mode resonator with a tuning screw inserted in a hollow the filter assembly according to the present solution offers improved performance in the shape of a higher Q-value and improved power handling capability.

When using the word "comprise" or "comprising" it shall be interpreted as non-limiting, in the meaning of "consist at least of".

The present invention is not limited to the above-described preferred embodiments. Various alternatives, modifications and equivalents may be used. Therefore, the above embodiments should not be taken as limiting the scope of the invention, which is defined by the appending claims.

The invention claimed is:

1. A dielectric rod for a filter chassis, the dielectric rod extending between a first end and a second end of the dielectric rod, the dielectric rod comprising:

a conductive element placed at the first end, wherein the conductive element is adapted to be in conductive contact with a first contact of the filter chassis; and a second fastening element placed at the second end;

wherein the second fastening element is externally threaded for releasably engaging a corresponding internally threaded first fastening element of the filter chassis, to releasably mate the dielectric rod to the filter chassis such that the dielectric rod is replaceable in the filter chassis;

wherein the second fastening element comprises a projecting element; wherein a longitudinal axis of the dielectric rod extends through the second fastening element and the conductive element; and wherein the conductive element comprises a second projecting element that is tapered in a direction away from the first end.

2. The dielectric rod according to claim 1, wherein the conductive element is flexible, or elastic, or both flexible and elastic.

3. The dielectric rod according to claim 1, wherein the conductive element is placed at the first end using solder, conductive glue, or both solder and conductive glue.

4. The dielectric rod according to claim 1, wherein the second fastening element is placed at the second end using solder, or conductive glue, or both solder and conductive glue.

5. A filter chassis adapted to releasably mate to a dielectric rod within the filter chassis, the filter chassis comprising:

a first contact at a first end of the filter chassis, the first contact comprising a first projecting element adapted to be in conductive contact with a conductive element of the dielectric rod; and a first fastening element at an opposite second end of the filter chassis, the first fastening element being internally threaded along an annular opening to releasably engage an externally threaded second fastening element of the dielectric rod when the dielectric rod is inserted into and axially aligned with the filter chassis, for releasably mating the dielectric rod to the filter chassis such that the dielectric rod is replaceable in the filter chassis;

wherein when the dielectric rod is mated to the filter chassis, a longitudinal axis of the dielectric rod extends through the annular opening of the first fastening element; and wherein the first projecting element is tapered in a direction away from the second end of the filter chassis, and is positioned to contact a conductive element of the dielectric rod when the first fastening element is engaged with the second fastening element.

6. The filter chassis according to claim 5:

wherein the first contact is one of a plurality of first contacts, and at least two of the plurality of first contacts are orthogonally arranged; and wherein the first fastening element is one of a plurality of first fastening elements, and at least two of the plurality of first fastening elements are orthogonally arranged.

7. The filter chassis according to claim 5, further comprising a third fastening element being adapted to attach and detach a fourth fastening element, the fourth fastening element being adapted to be attached and detached to the third fastening element.

8. The filter chassis according to claim 7:

wherein the third fastening element is one of a plurality of third fastening elements, and at least two of the plurality of third fastening elements are orthogonally arranged; and wherein the fourth fastening element is one of a plurality of fourth fastening elements, and at least two of the plurality of fourth fastening elements are orthogonally arranged.

9. The filter chassis according to claim 7, further comprising a fifth fastening element being adapted to be used together with the fourth fastening element.

10. A filter assembly comprising:

a filter chassis; and a dielectric rod adapted to releasably mate to the filter chassis, wherein the dielectric rod extends between a first end and a second end of the dielectric rod, and comprises:

a conductive element placed at the first end; and a second fastening element placed at the second end, wherein the second fastening element is externally threaded, and wherein the second fastening element comprises a projecting element;

wherein a longitudinal axis of the dielectric rod extends through the second fastening element and the conductive element;

wherein said filter chassis comprises:

a first contact at a first end of the filter chassis, the first contact comprising an additional projecting element; and a first fastening element at an opposite second end of the filter chassis, the first fastening element being internally threaded to releasably engage the externally threaded second fastening element of the dielectric rod when the dielectric rod is inserted into and axially aligned with the filter chassis along the longitudinal axis, for releasably mating the dielectric rod to the filter chassis such that the dielectric rod is replaceable in the filter chassis wherein the filter assembly further comprises:

a filter cover situated at the first end of the filter chassis, wherein the first contact of the filter chassis is a part of the cover, and wherein a portion of the filter cover forms a third fastening element that is internally threaded; and a fourth fastening element that is externally threaded to releasably engage the internally threaded third fastening element to at least partially enclose the dielectric rod within the filter chassis when the dielectric rod is mated to the filter chassis;

wherein the additional projecting element is situated on a first side of the conductive element of the dielectric rod, and the fourth fastening element is situated on a second opposite side of the conductive element of the dielectric rod.

11. The filter assembly according to claim 10, wherein the dielectric rod is one of a plurality of dielectric rods included in the filter assembly.

12. The filter assembly according to claim 11, wherein the plurality of dielectric rods are arranged in parallel to form a Transverse Electric filter.

13. The filter assembly according to claim 11, wherein the plurality of dielectric rods are orthogonally arranged to form a Transverse Magnetic filter.

14. The filter assembly according to claim 10, wherein the filter assembly comprises part of a radio transmission device.

15. The filter assembly according to claim 14, wherein the radio transmission device comprises a radio base station, a Tower Mounted Amplifier (TMA), or a Radio Remote Unit (RRU).

16. A dielectric rod for a filter chassis, the dielectric rod extending between a first end and a second end of the dielectric rod, the dielectric rod comprising:

a conductive element placed at the first end, which conductive element is adapted to be in conductive contact with a first contact of the filter chassis; and a second fastening element placed at the second end;

wherein the second fastening element is externally threaded for releasably engaging a corresponding internally threaded first fastening element of the filter chassis, to releasably mate the dielectric rod to the filter chassis such that the dielectric rod is replaceable in the filter chassis;

wherein the second fastening element comprises a projecting element;

wherein a longitudinal axis of the dielectric rod extends through the second fastening element and the conductive element; and wherein the projecting element is tapered in a direction away from the first end, and is adapted to contact the filter chassis when the first and second fastening elements are engaged.

17. A filter assembly comprising:

a filter chassis; and a dielectric rod adapted to releasably mate to the filter chassis, wherein the dielectric rod extends between a first end and a second end of the dielectric rod, and comprises:

a conductive element placed at the first end; and a second fastening element placed at the second end, wherein the second fastening element is externally threaded, and wherein the second fastening element comprises a projecting element;

wherein a longitudinal axis of the dielectric rod extends through the second fastening element and the conductive element;

wherein said filter chassis comprises:

a first contact at a first end of the filter chassis, the first contact comprising an additional projecting element; and a first fastening element at an opposite second end of the filter chassis, the first fastening element being internally threaded to releasably engage the externally threaded second fastening element of the dielectric rod when the dielectric rod is inserted into and axially aligned with the filter chassis along the longitudinal axis, for releasably mating the dielectric rod to the filter chassis such that the dielectric rod is replaceable in the filter chassis;

wherein the projecting element of the second fastening element is tapered in a direction away from the first end of the dielectric rod, and is adapted to contact the filter chassis when the first fastening element is engaged with the second fastening element; and wherein the additional projecting element of the filter chassis is tapered in a direction away from the second end of the filter chassis, and is positioned to contact the conductive element of the dielectric rod when the first fastening element is engaged with the second fastening element.

18. The filter assembly of claim 10:

wherein the first fastening element is internally threaded along an annular opening; and wherein when the dielectric rod is engaged in the filter chassis and is axially aligned with the filter chassis, the longitudinal axis of the dielectric rod passes through the annular opening of the first fastening element.

* * * * *